US011504565B2

(12) United States Patent
Li

(10) Patent No.: US 11,504,565 B2
(45) Date of Patent: Nov. 22, 2022

(54) EXERCISE ROD FOR SUPPORTING EXERCISE ELASTIC ROPE

(71) Applicant: Quanzhou Fengdong Sports Goods Co., Ltd, Quanzhou (CN)

(72) Inventor: Linlin Li, Quanzhou (CN)

( * ) Notice: Subject to any disclaimer, the term of this patent is extended or adjusted under 35 U.S.C. 154(b) by 79 days.

(21) Appl. No.: 17/113,148

(22) Filed: Dec. 7, 2020

(65) Prior Publication Data

US 2021/0394007 A1 Dec. 23, 2021

(30) Foreign Application Priority Data

Jun. 19, 2020 (CN) ..... 202021145626.9

(51) Int. Cl.
*A63B 21/055* (2006.01)
*A63B 21/02* (2006.01)
(Continued)

(52) U.S. Cl.
CPC ..... *A63B 21/0557* (2013.01); *A63B 21/0004* (2013.01); *A63B 21/026* (2013.01);
(Continued)

(58) Field of Classification Search
CPC ..... A63B 21/0557; A63B 21/0004; A63B 21/026; A63B 21/151; A63B 21/4035; A63B 21/00043; A63B 21/0552; A63B 21/4034; A63B 1/00–04; A63B 3/00; A63B 5/00; A63B 5/04; A63B 5/20; A63B 5/205; A63B 7/00–085; A63B 9/00–2009/004; A63B 15/00–02; A63B 21/00058–00065; A63B 21/02; A63B 21/04; A63B 21/0407–0442; A63B 21/05–0557; A63B 21/15; A63B 21/16–169; A63B 21/4033–4035;
(Continued)

(56) References Cited

U.S. PATENT DOCUMENTS 5,885,196 A * 3/1999 Gvoich ..... A63B 21/00185 482/125
11,213,712 B1 * 1/2022 Lejuez ..... A63B 23/1209
(Continued)

FOREIGN PATENT DOCUMENTS

CN 210728532 U 6/2020

*Primary Examiner* — Joshua Lee
*Assistant Examiner* — Catrina A Letterman

(57) ABSTRACT

An exercise rod for supporting an exercise elastic rope includes a supporting member rotatably sleeved on the exercise rod. The periphery of the supporting member is provided with an annular positioning groove for cooperating with a hook. An end of the exercise rod is detachably provided with a blocking member configured to prevent the supporting member from separation, a retractable blocking button is arranged adjacent to the end of the exercise rod, and the supporting member is limited between the blocking button and the blocking member. The supporting member is rotatably sleeved on the exercise rod, and the supporting member is provided with a positioning groove matched with the hook. When the hook is subjected to force, the relative movement between the hook and the supporting member is transformed into the rotation of the supporting member, thereby eliminating the sound caused by friction and collision between parts.

8 Claims, 10 Drawing Sheets

(51) Int. Cl.
*A63B 21/00* (2006.01)
*A63B 21/04* (2006.01)

(52) U.S. Cl.
CPC ..... *A63B 21/0407* (2013.01); *A63B 21/151* (2013.01); *A63B 21/4035* (2015.10)

(58) Field of Classification Search
CPC .... A63B 22/0076–2022/0084; A63B 21/4005; F16M 13/04; F16M 13/00; F16M 13/02; A45F 3/14; A45F 3/10; A45F 2003/146; Y10S 224/907; Y10S 224/925; A47G 2023/0675
USPC ..... 224/265, 201, 260, 271–272; 403/256, 403/258, 259, 261
See application file for complete search history.

(56) References Cited

U.S. PATENT DOCUMENTS

2005/0239617 A1* 10/2005 Tenaglia ..... A63B 21/0552 482/904
2008/0287272 A1* 11/2008 Luckadue ..... A63B 21/0552 482/107
2010/0323852 A1* 12/2010 Locsin ..... A63B 1/00 482/96
2019/0099634 A1* 4/2019 Sanseverino ..... A63B 23/12
2021/0154522 A1* 5/2021 Wu ..... A63B 23/03525

* cited by examiner

EXERCISE ROD FOR SUPPORTING EXERCISE ELASTIC ROPE

CROSS REFERENCE TO THE RELATED APPLICATIONS

This application is based upon and claims priority to Chinese Patent Application No. 202021145626.9, filed on Jun. 19, 2020, the entire contents of which are incorporated herein by reference.

TECHNICAL FIELD

The present invention relates to an exercise rod.

BACKGROUND

Chinese patent No. 210728532 U discloses a portable fitness puller, including a first main body shell and a second main body shell which can be folded and connected through a hinge. A force pedal is embedded at the middle of each of the first main body shell and the second main body shell. A plurality of U-shaped ring rope lugs are uniformly mounted on the front of each of the first main body shell and the second main body shell at the side of the force pedal. The portable fitness puller can be easily folded and stowed when not in use or for easy transport, so as to meet the needs of different occasions. The portable fitness puller also has a low production cost. In use, the first main body shell and the second main body shell are unfolded and laid flat on the floor, and the left and right feet of the user separately stand on the middle of the force pedals of the first main shell and the second main shell. The two ends of the exercise rod are connected to the U-shaped ring rope lug through the exercise elastic rope. The user grasps the exercise rod with both hands to repeatedly perform a pull or push motion, so as to form a pull system needed for exercise.

When the exercise elastic rope of the fitness puller with the above structure is subjected to force, especially when the user adjusts or moves the feet thereof, the pulling force is stressed entirely on the hinge. Such stress on the hinge can easily cause damage and also results in the destructive separation of the first main body shell and the second main body shell. In addition, because the position of the force pedal is fixed, it cannot adapt to users of different stature. Moreover, the exercise elastic rope is connected to the U-shaped rope lug or the hanging ring on the exercise rod through the hanging ring, and the hanging ring and the U-shaped ring rope lug are made of metal. These particular metal rings, when subjected to constant force or friction collide against each other, will generate a loud sound, which is not enjoyable for the user's exercise experience.

SUMMARY

In view of the shortcomings of the prior art, an objective of the present invention is to provide an exercise rod that can eliminate the sound generated during exercise.

The objective of the present invention is realized by the following technical solution.

An exercise rod for supporting an exercise elastic rope includes an exercise rod. A supporting member is rotatably sleeved on both ends of the exercise rod, respectively, and the periphery of the supporting member is provided with an annular positioning groove configured to receive the exercise elastic rope.

The exercise rod for supporting the exercise elastic rope further includes a hook. One end of the hook is rotatably arranged on the annular positioning groove, and the other end of the hook is provided with a hook-shaped hanging portion configured to connect the exercise elastic rope and the hook.

An end of the exercise rod is detachably provided with a blocking member configured to prevent the supporting member from separation, and a blocking button is arranged adjacent to the end of the exercise rod. The supporting member is limited between the blocking button and the blocking member.

The exercise rod is a tubular structure. The end of the exercise rod is provided with a plugging tubular member, and the plugging tubular member is set in an end opening of the exercise rod. The plugging tubular member is provided with a screw hole extending along the axis of the plugging tubular member, the blocking member is provided with a screw rod matched with the screw hole, and the blocking member is detachably arranged on the plugging tubular member through the screw rod.

The plugging tubular member is provided with a plugging portion capable of being plugged into the exercise rod, and a limiting end.

The supporting member is made of a plastic material or a steel material.

An end of the hook cooperating with the supporting member is provided with an annular portion, wherein the annular portion is configured to surround the supporting member and located in the annular positioning groove.

The annular positioning groove is arranged at the middle of the supporting member.

The supporting member is provided with a center hole passing through the supporting member along the axis of the supporting member, and the supporting member is rotatably sleeved on the exercise rod through the center hole.

The supporting member includes a main kit and a secondary kit, and the main kit and the auxiliary kit are clamped and connected by a fastener and a clamping groove.

The present invention has the following advantages.

A supporting member for supporting a hook is arranged on the exercise rod, the supporting member is rotatably sleeved on the exercise rod, and the supporting member is provided with a positioning groove matched with the hook. In this way, when the hook is subjected to force, the relative movement between the hook and the supporting member is transformed into the rotation of the supporting member, thereby eliminating the sound caused by the friction and collision between parts.

The supporting member can be limited between the blocking button and the blocking member, so as to fix the supporting member. Additionally, the supporting member may be moved to the middle of the exercise rod by operating the blocking button, so that the middle of the exercise elastic rope is supported on the supporting member located at the middle of the exercise rod to form an exercise mode in which the middle of the exercise rod is subjected to force. For example, the exerciser can use two hands to hold both sides on the middle of the exercise rod to perform the pull exercise of the arm.

In addition to the pull exercise, the present invention can be used to do the push-up exercise. Two second insertion portions of a handle can be selectively docked with the two first insertion portions of a plate body to fix the handle, thereby forming a push-up auxiliary device. Two plate bodies are spliced together through the protrusion and the recess during the push-up exercise, which can prevent the two plate bodies from wrongly moving back and forth during the exercise and avoid affecting the exercise results.

During exercise, the left and right feet step on two plate bodies, respectively. Each plate body is equipped with an exercise elastic rope, and both ends of the exercise elastic rope are connected to the fixing structure on both sides of the plate body to form a pull system for exercising muscles. The pull system can cooperate with the exercise rod to do the pull exercise, the squat exercise, and the push exercise for the arm. Alternatively, the pull system can cooperate with the handle to do the pull exercise and the push exercise for the arm. The subjected tension of the plate body is evenly distributed on the exercise elastic ropes on both sides to form a stable pull system. During exercise, the user can adjust the distance between steps as needed without affecting the stability of the pull system.

The end of the exercise elastic rope is provided with a limiting portion and an anti-separation component. The limiting portion is larger than the mounting hole, and the anti-separation component is larger than the lateral opening. The limiting portion is configured to restrict the end of the exercise elastic rope from being separated from the mounting hole. The anti-separation component is moved to the mounting hole after the exercise elastic rope is subjected to upward force. The anti-separation component is configured to prevent the end of the exercise elastic rope from being separated from the mounting hole laterally, so as to realize the firm connection of the exercise elastic rope. In addition, the exercise elastic rope can be rapidly disassembled and assembled by means of the above structure. For example, the exercise elastic rope is pulled downward to enable the anti-separation component to separate from the mounting hole, so that the exercise elastic rope can be removed from the lateral opening. The anti-separation component is a pipe body sleeved on the exercise elastic rope, which has the advantages of a simple structure, a convenient assembly and a low cost.

BRIEF DESCRIPTION OF THE DRAWINGS

The present invention is further explained in detail with reference to the drawings.

DETAILED DESCRIPTION OF THE EMBODIMENTS

Figure 5:
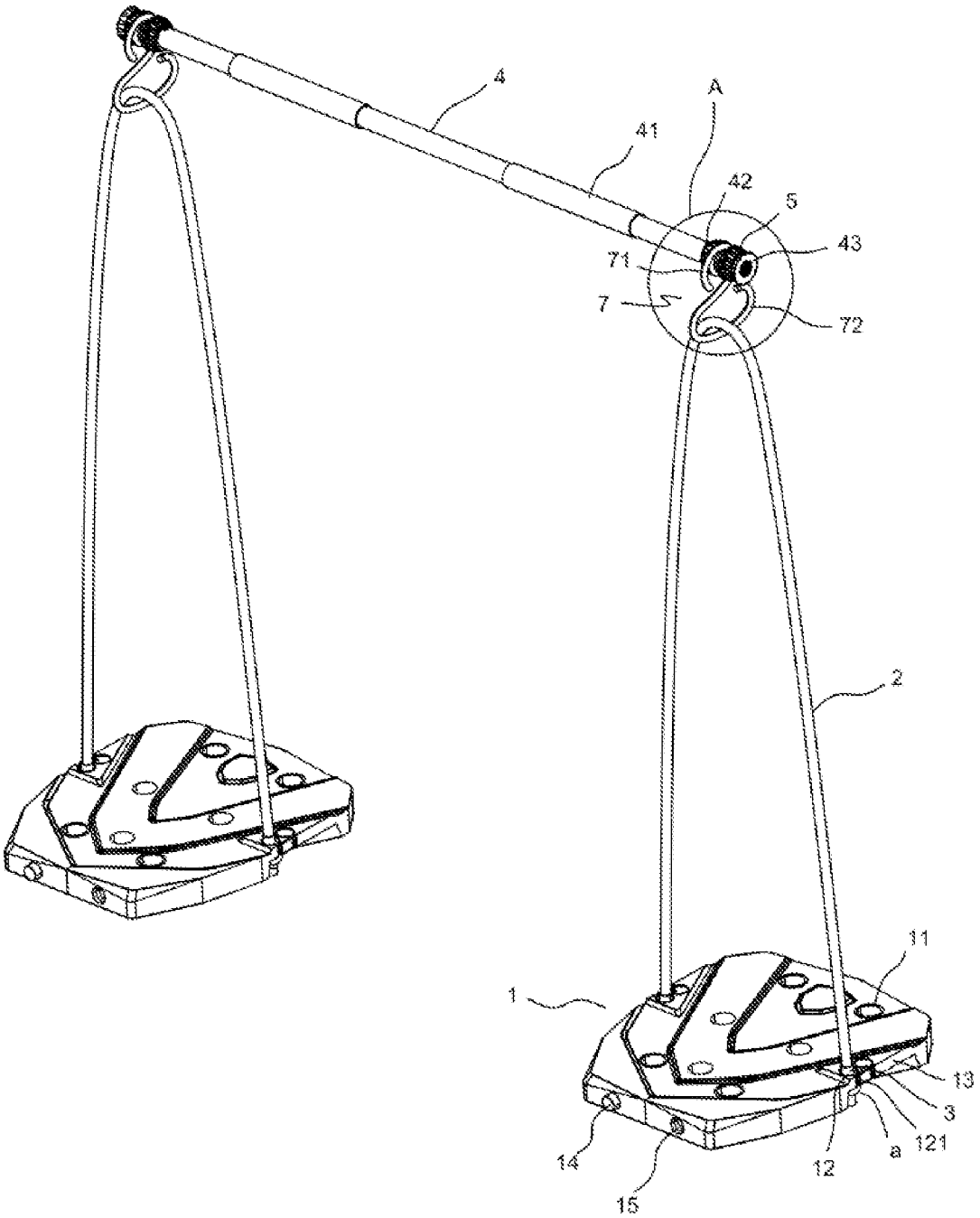
FIG. 5 is a schematic diagram of the use state of the present invention employing an exercise rod.
Figure 6:
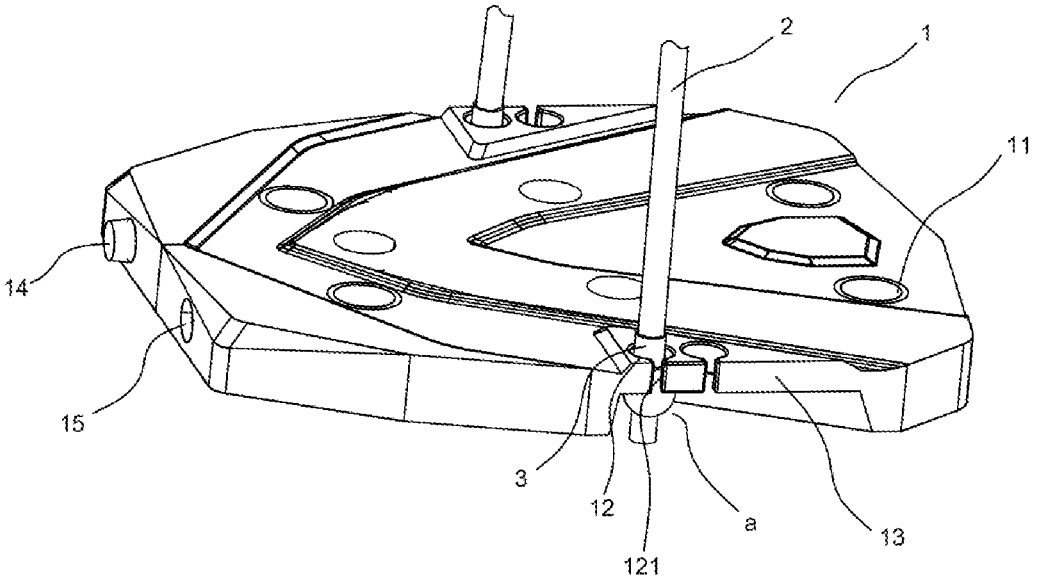
FIG. 6 is a schematic diagram of the connection between the plate body and the exercise elastic rope.
Figure 7:
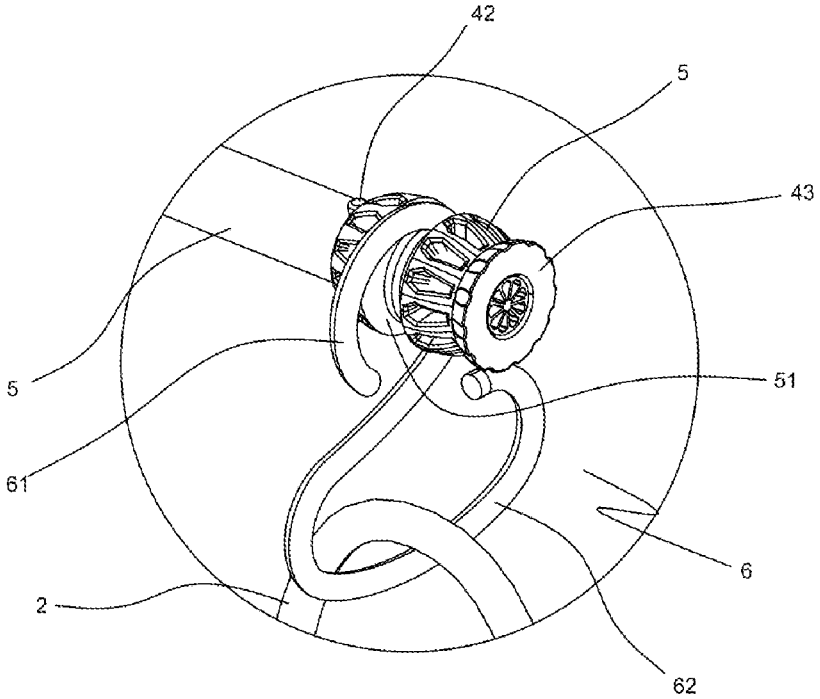
FIG. 7 is an enlarged view of the part A of FIG. 5.
Figure 8:
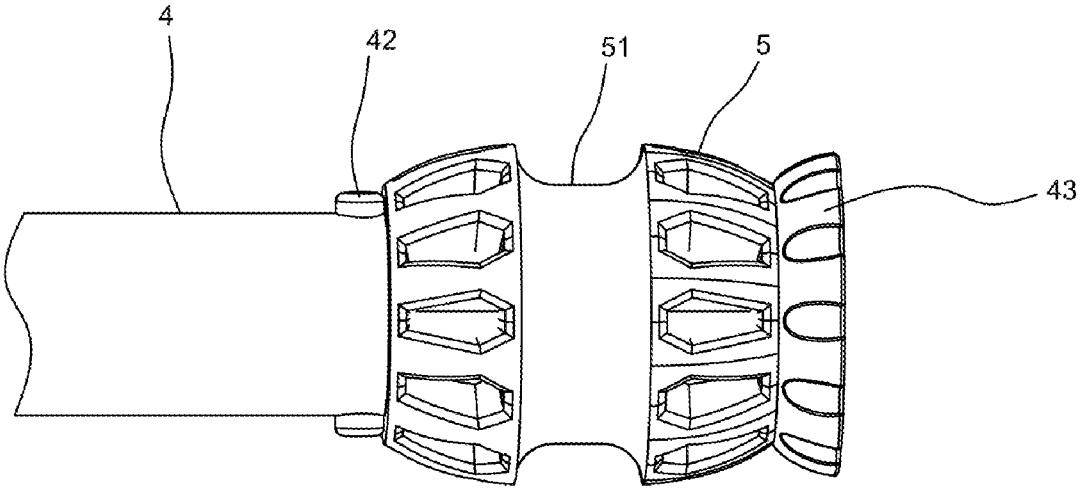
FIG. 8 is a locally enlarged view of the exercise rod.
Figure 9:
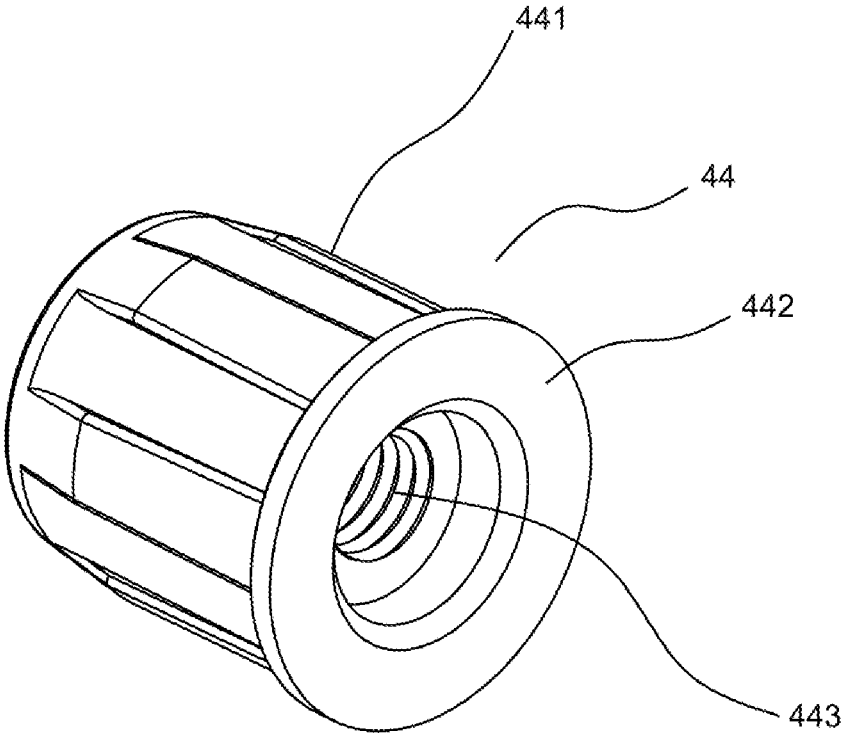
FIG. 9 is a perspective view of the plugging tubular member.
Figure 10:
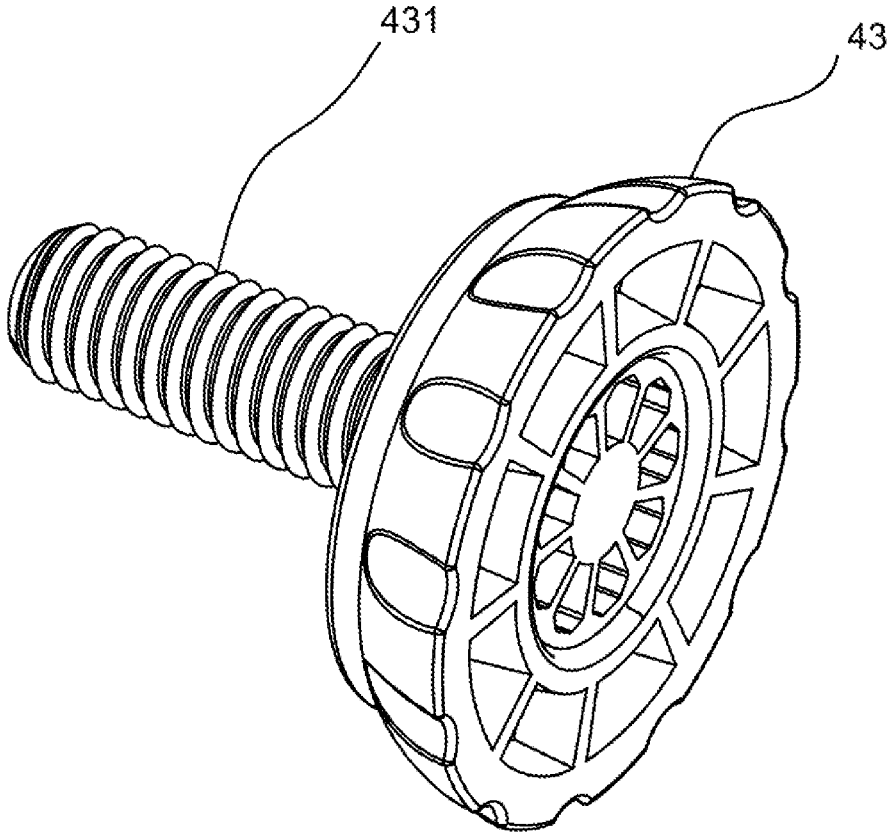
FIG. 10 is a perspective view of the blocking member.
Figure 11:
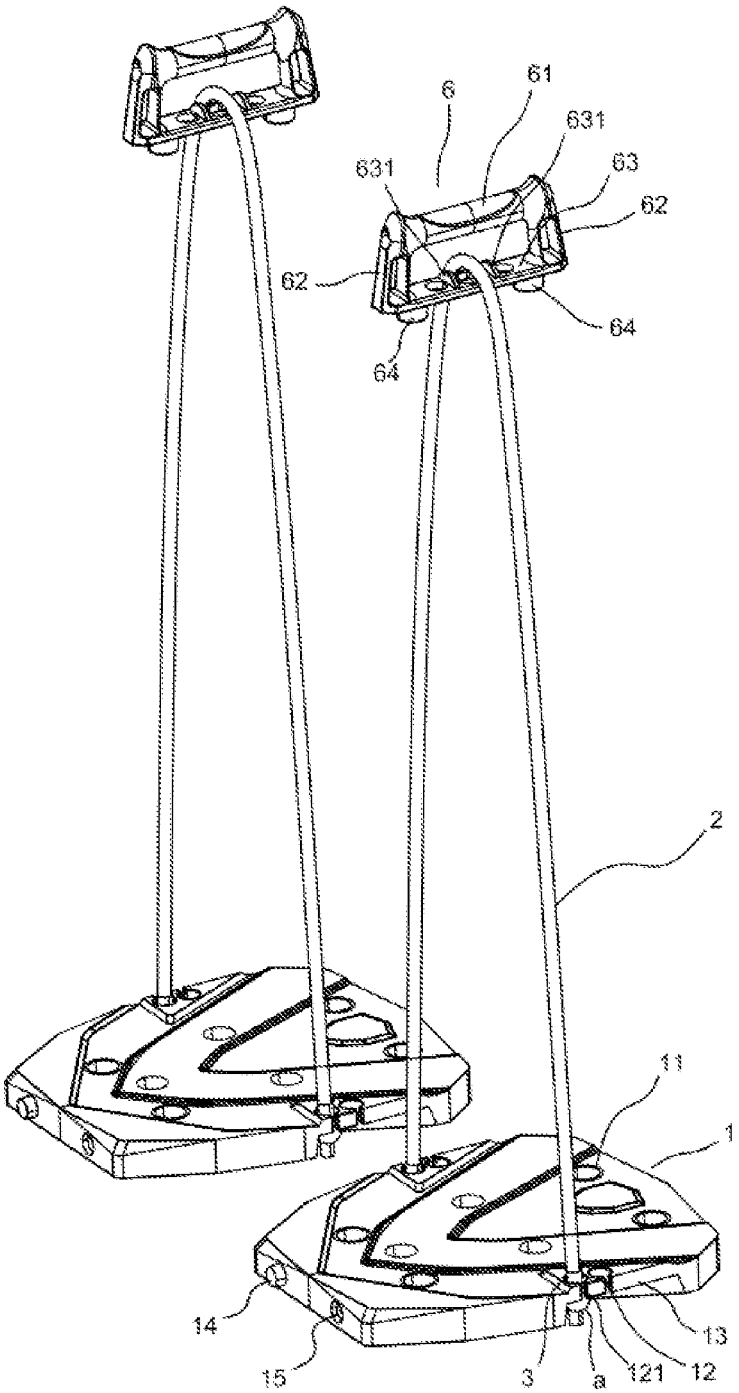
FIG. 11 is a schematic diagram of the use state of the present invention employing a handle.
Figure 12:
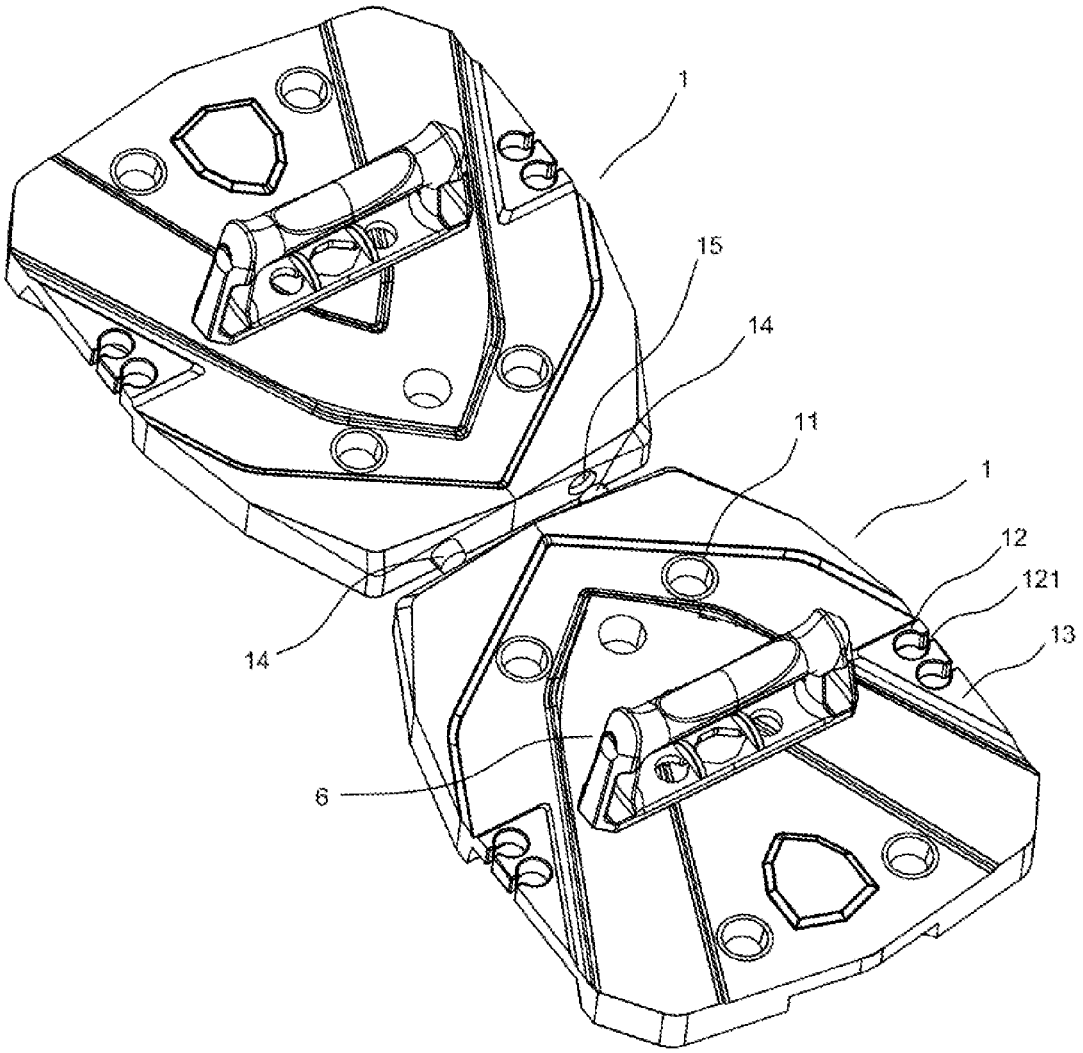
FIG. 12 is the use state diagram of the present invention as a push-up auxiliary device.
Figure 13:
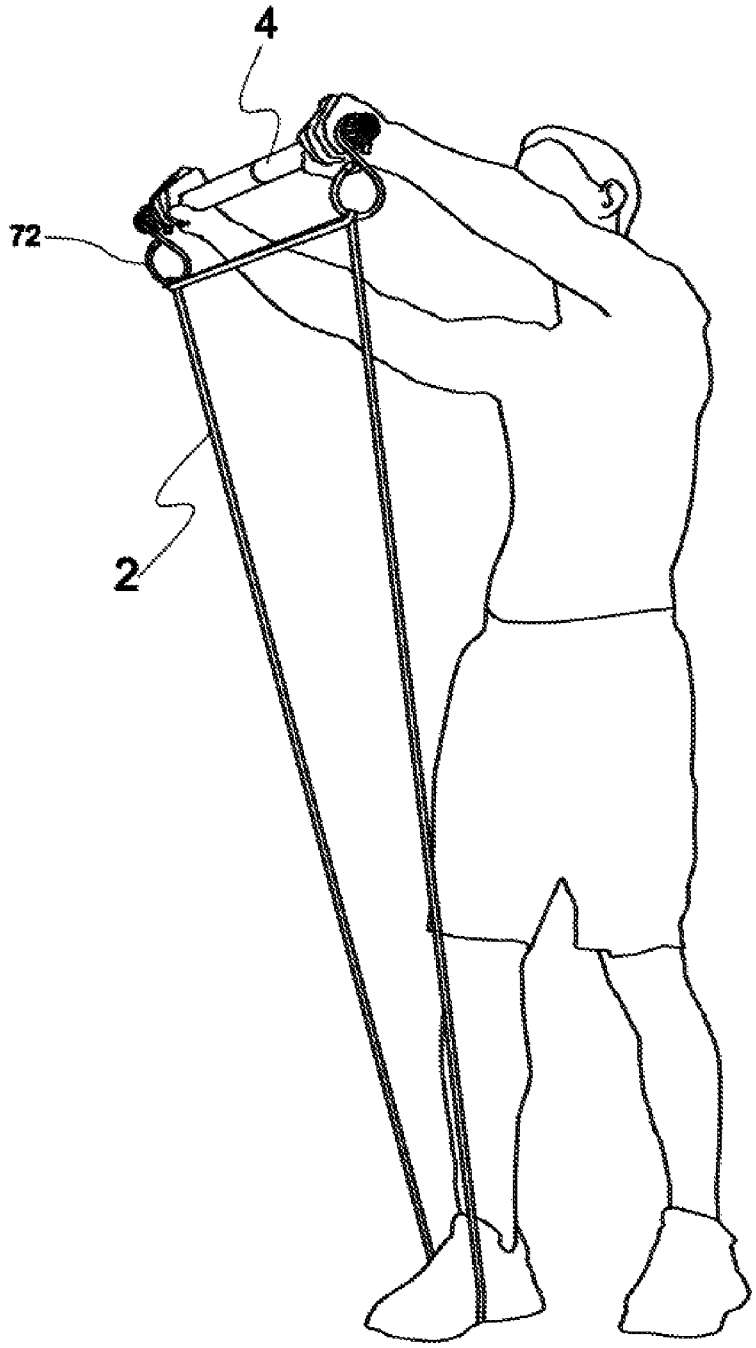
FIG. 13 is a schematic diagram of the use state of the present invention using the exercise rod and the exercise elastic rope.
Figure 14:
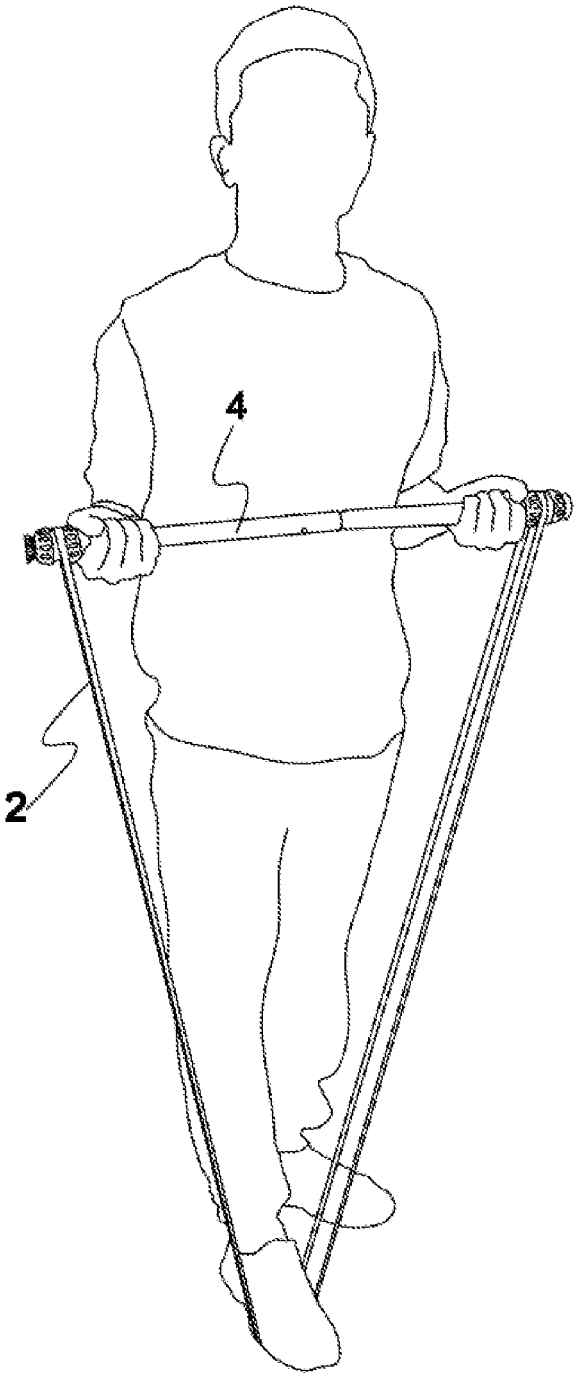
FIG. 14 is a schematic diagram of the use state of the present invention using the exercise rod, the hook and the exercise elastic rope.

Referring to FIGS. 1-12, an exercise apparatus includes two plate bodies 1, two handles 6, the exercise elastic rope 2 and the exercise rod 4. The user can choose different exercise modes as needed. As shown in FIG. 13, the exercise rod 4 and the exercise elastic rope 2 may directly form a pull system for exercising muscles, and the user uses the combination of the exercise rod 4 and the exercise elastic rope 2 to exercise the shoulder or the arm for building up the strength thereof. Alternatively, as shown in FIG. 14, the exercise rod 4, the hook and the exercise elastic rope form a pull system for exercising muscles, and the user uses the combination of the exercise rod 4, the hook and the exercise elastic rope to exercise the arm for building up the strength thereof. Alternatively, as shown in FIG. 5, two plate bodies 1, two exercise elastic ropes 2 and the exercise rod 4 form a pull system for exercising muscles. Alternatively, as shown in FIG. 11, two plate bodies 1, two exercise elastic ropes 2 and two handles 6 form a pull system for exercising muscles. Alternatively, as shown in FIG. 12, two plate bodies 1 and two handles 6 cooperate to form a push-up auxiliary device.

Figure 1:
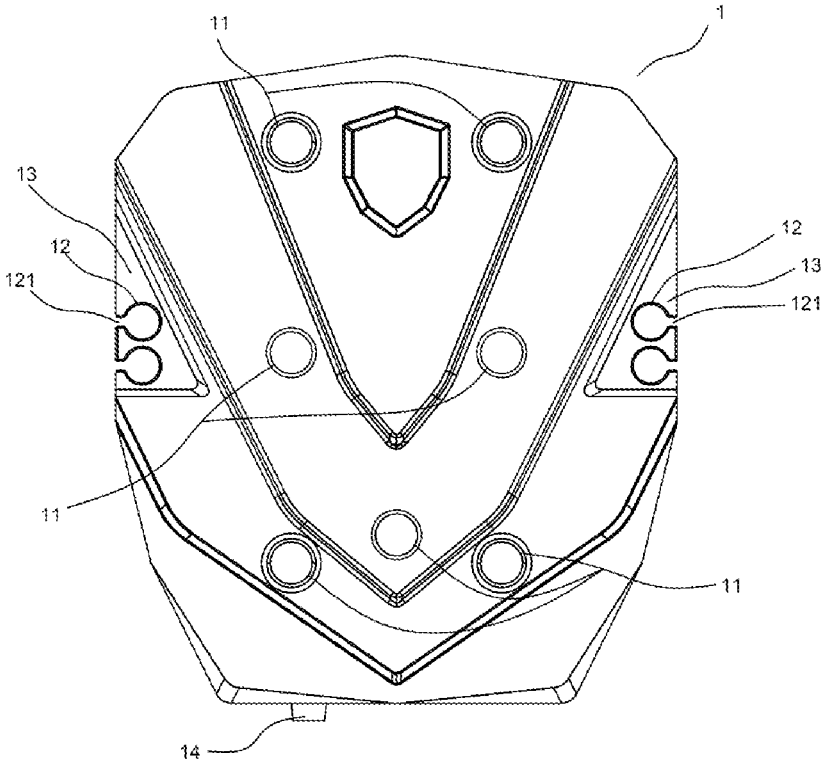
FIG. 1 is a top view of the plate body of the present invention.
Figure 2:
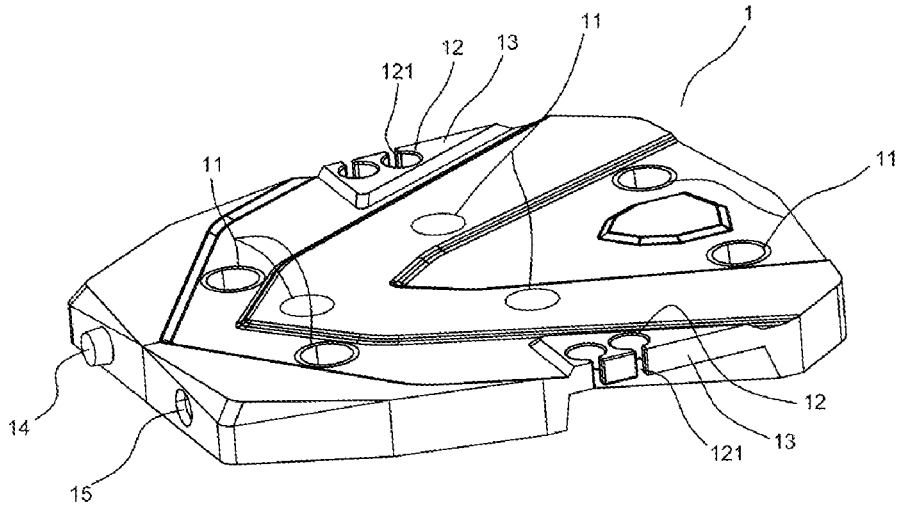
FIG. 2 is a perspective view showing the top surface structure of the plate body of the present invention.
Figure 3:
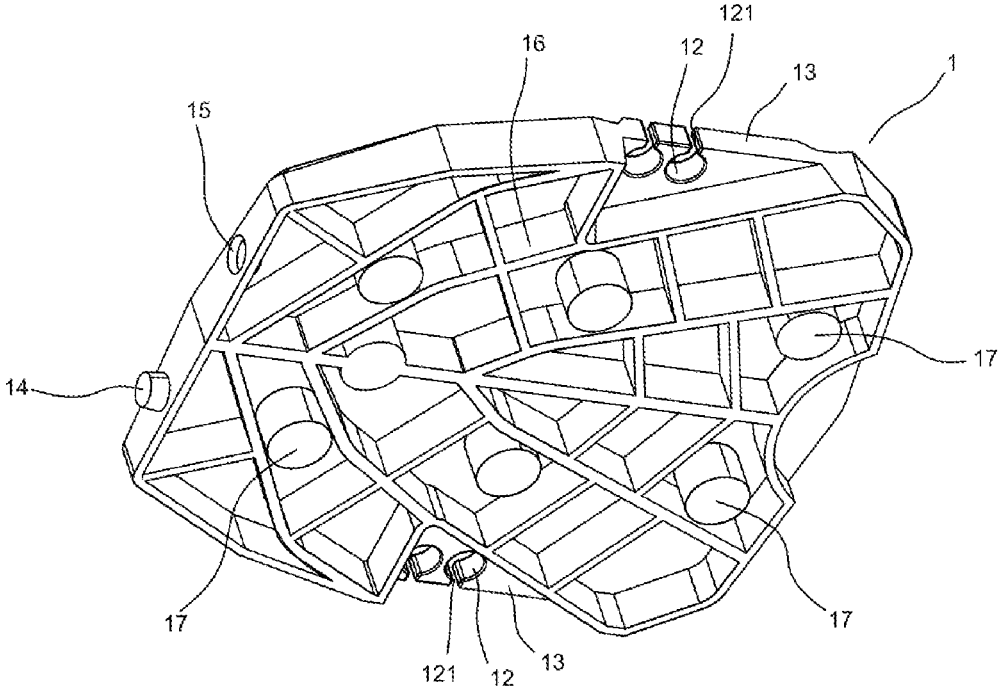
FIG. 3 is a perspective view showing the bottom structure of the plate body of the present invention.
Figure 4:
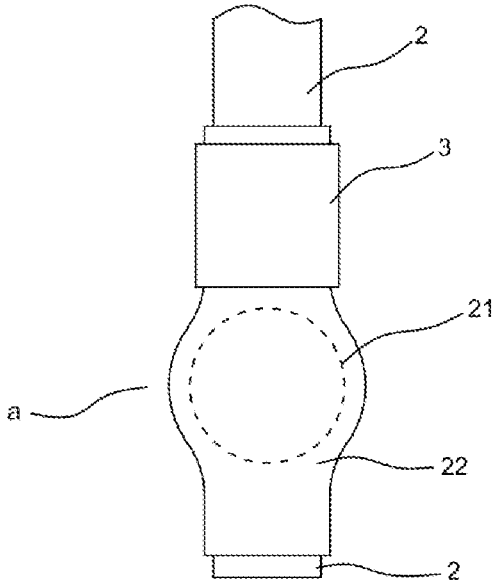
FIG. 4 is a schematic diagram of the structure of the end of the exercise elastic rope.

Referring to FIGS. 1-3, the plate body 1 is an injection molded piece, and a plurality of first insertion portions are formed on the top surface of the plate body 1. Specifically, the first insertion portion is the insertion hole 11. The plate-shaped reinforcing rib 16 and a plurality of supporting columns 17 are formed on the bottom surface of the plate body 1, and the supporting column 17 is at least arranged directly under the insertion hole 11. The two plate bodies 1 can be spliced together as a whole. Specifically, the protrusion 14 and the recess 15 are separately formed on each of the splicing surfaces of the two plate bodies 1, so that the two plate bodies 1 are detachably spliced through the protrusion 14 and the recess 15, that is, after splicing, the protrusion 14 of one plate body 1 can be inserted into the recess 15 of the other plate body 1. The handle 6 includes the cross rod 61 for hand holding, the supporting rod 63 for supporting the exercise elastic rope 2, and two stand columns 62 connected between the cross rod 61 and the supporting rod 63. Two second insertion portions capable of docking with the first insertion portions are arranged on the bottom of the supporting rod 63. Specifically, the second insertion portion is the insertion rod 64. The two insertion rods 64 can be selectively inserted into the two insertion holes 11 to fix the handle 6, such that the user can do the push-up exercise. Specifically, as shown in FIG. 12, the two plate bodies 1 are spliced together through the protrusion 14 and the recess 15 during the push-up exercise, which can prevent the two plate bodies 1 from wrongly moving back and forth during the exercise and avoid affecting the exercise effect.

The thick plate-shaped reinforcing structure 13 is formed on the opposite sides of the plate body 1, respectively. Two mounting holes 12 provided with the lateral opening 121 are formed on the plate-shaped reinforcing structure 13. The mounting hole 12 is a circular hole, and the lateral opening 121 of the mounting hole 12 is smaller than the diameter of the mounting hole 12. The lateral opening 121 is minimized under the condition that the exercise elastic rope 2 can smoothly pass through the lateral opening 121.

The exercise elastic rope 2 is a circular rope structure. The limiting portion a and the anti-separation component 3 are arranged at the end of the exercise elastic rope 2. Specifically, the end of the exercise elastic rope 2 is sleeved with the limiting sphere 21, and the rubber sleeve 22 covering the limiting sphere 21 is sleeved on the end of the exercise elastic rope 2. The diameter of the limiting sphere 21 is larger than the diameter of the exercise elastic rope 2, so as to form the expanded limiting portion a at the end of the exercise elastic rope 2. The limiting sphere 21 may be made of wooden, plastic and others. The anti-separation component 3 is a pipe body sleeved on the exercise elastic rope 2. When the exercise elastic rope 2 is installed into the mounting hole 12 through the lateral opening 121, the exercise elastic rope 2 is pulled upward to drive the anti-separation component 3 to move into the mounting hole 12. The limiting portion a is located under the mounting hole 12, and the limiting portion a is larger than the mounting hole 12, so that the exercise elastic rope 2 cannot be separated upward from the mounting hole 12. The diameter of the pipe body is smaller than the mounting hole 12 and larger than the lateral opening 121, so that the exercise elastic rope 2 cannot be separated from the mounting hole 12 through the lateral opening 121. The exercise elastic rope 2 can be easily disassembled, that is, the exercise elastic rope 2 is pulled downward to enable the anti-separation component 3 to separate from the mounting hole 12, so that the exercise elastic rope 2 can be removed from the lateral opening 121.

Two plugging tubular members 44, two blocking members 43, two supporting members 5 and two buffering holding sleeves 41 are arranged on the exercise rod 4. The exercise rod 4 is a metal pipe body, and the two buffering holding sleeves 41 are detachably sleeved on the exercise rod 4 for hand holding. The two plugging tubular members 44 are sleeved in the openings at both ends of the exercise rod 4. The plugging tubular member 44 is made of plastic. The plugging tubular member 44 is provided with the plugging portion 441 capable of being plugged into the exercise rod 4, and the limiting end 442. The limiting end 442 of the plugging tubular member 44 is provided with the screw hole 443 extending along the axis of the plugging tubular member 44. The blocking member 43 is provided with the screw rod 431 matched with the screw hole 443. The blocking member 43 is detachably arranged on the plugging tubular member 44 through the screw rod 431. The two supporting members 5 are rotatably sleeved on both ends of the exercise rod 4, and the supporting member 5 is made of plastic. The periphery of the supporting member 5 is provided with the annular positioning groove 51, and the annular positioning groove 51 is arranged at the middle of the supporting member 5. The supporting member 5 is provided with a center hole that passes through the supporting member 5 along the axis of the supporting member 5, and the supporting member 5 is rotatably sleeved on the exercise rod 4 through the center hole. The retractable blocking button 42 is arranged adjacent to the end of the exercise rod 4, and an elastic member that drives the blocking button 42 to protrude is arranged in the exercise rod 4. The specific structure of the blocking button 42 is well-known, and thus not described in detail herein. The supporting member 5 may be limited between the blocking button 42 and the blocking member 43. The diameter of the blocking member 43 is larger than the hole diameter of the supporting member 5. In use, both ends of the exercise elastic rope 2 are fixed in the mounting holes 12 on both sides of the plate body 1, and the middle of the exercise elastic rope 2 is supported on the supporting member 5 through the hook 7. The hook 7 is formed by bending the metal strip, and the cross section of the metal strip is circular. One end of the hook 7 is provided with the annular portion 71 that surrounds the supporting member 5 and is located in the annular positioning groove 51. The other end of the hook 7 is provided with the hook-shaped hanging portion 72, and the middle of the exercise elastic rope 2 is hung on the hanging portion 72. Referring to the FIGS. 5 and 7, during exercise, both ends of each of the two exercise elastic ropes 2 are fixed on both sides of the corresponding plate body 1, and then the middle of each of the two exercise elastic ropes 2 is supported on the supporting member 5 at both ends of the exercise rod 4 through the hook 7. The left and right feet step on the two plate bodies 1, respectively, and the hand holds the exercise rod 4, so as to form a pull system for exercising muscles. In this way, the user can do the squat exercise, the pull exercise and others. When the hook 7 is subjected to force, the relative movement between the hook 7 and the supporting member 5 is transformed into the rotation of the supporting member 5, thereby eliminating the sound caused by the friction and collision between parts.

Additionally, the supporting member 5 may be moved to the middle of the exercise rod 4 by pressing the blocking button 42, so that the middle of the exercise elastic rope 2 is supported on the supporting member 5 located at the middle of the exercise rod 4 to form an exercise mode in which the middle of the exercise rod 4 is subjected to force. For example, two hands of the user can hold both sides of the exercise rod 4 to do the pull exercise of the arm.

Two protruding positioning portions 631 are arranged on the top of the supporting rod 63 of the handle 6, and the exercise elastic rope 2 can be limited between the two positioning portions 631. As shown in FIG. 11, during exercise, the exercise elastic rope 2 passes through the center hole of the handle 6, so that the middle of the exercise elastic rope 2 is supported on the support rod 63 between the two positioning portions 631, and then both ends of each of the two exercise elastic ropes 2 are fixed on both sides of the corresponding plate body 1. The left and right feet step on the two plate bodies 1, respectively, and the hand holds the cross rod 61 of the handle 6, so as to form a pull system for exercising muscles. In this way, the user can do the push exercise, the pull exercise and others.

The above is only a prefer embodiment of the present invention, which is not construed to limit the scope of implementation of the present invention. The equivalent variations and modifications made according to the scope of the patent application and the contents of the specification shall fall within the scope of protection of the present invention.

What is claimed is:

1. An exercise rod for supporting an exercise elastic rope, comprising a supporting member; wherein the supporting member is rotatably sleeved on both ends of the exercise rod, respectively, and a periphery of the supporting member is provided with an annular positioning groove, wherein, an end of the exercise rod is detachably provided with a blocking member, wherein the blocking member is configured to prevent the supporting member from separation; a blocking button is arranged adjacent to the end of the exercise rod; the supporting member is limited between the blocking button and the blocking member.

2. The exercise rod according to claim 1, further comprising a hook; wherein, a first end of the hook is rotatably arranged on the annular positioning groove, and a second end of the hook is provided with a hook-shaped hanging portion, wherein the hook-shaped hanging portion is configured to connect the exercise elastic rope and the hook.

3. The exercise rod according to claim 2, wherein, the first end of the hook is provided with an annular portion, wherein the annular portion is configured to surround the supporting member and located in the annular positioning groove.

4. The exercise rod according to claim 1, wherein, the exercise rod is a tubular structure; the end of the exercise rod is provided with a plugging tubular member, and the plugging tubular member is sleeved in an end opening of the exercise rod; the plugging tubular member is provided with a screw hole extending along an axis of the plugging tubular member, the blocking member is provided with a screw rod matched with the screw hole, and the blocking member is detachably arranged on the plugging tubular member through the screw rod.

5. The exercise rod according to claim 4, wherein, the plugging tubular member is provided with a plugging portion and a limiting end, wherein the plugging portion is allowed to be plugged into the exercise rod.

6. The exercise rod according to claim 1, wherein, the supporting member is made of a plastic material or a steel material.

7. The exercise rod according to claim 1, wherein, the annular positioning groove is arranged at a middle of the supporting member.

8. The exercise rod according to claim 1, wherein, the supporting member is provided with a center hole passing through the supporting member along an axis of the supporting member, and the supporting member is rotatably sleeved on the exercise rod through the center hole.

* * * * *